US012569082B2

(12) United States Patent
Hoover et al.

(10) Patent No.: US 12,569,082 B2
(45) Date of Patent: Mar. 10, 2026

(54) PILLOW WITH VARIABLE CUSHIONING CHARACTERISTICS

(71) Applicant: Purple Innovation, LLC, Lehi, UT (US)

(72) Inventors: Wade H. Hoover, Lehi, UT (US); Dhyey Yogesh Acharya, Lehi, UT (US); Seth Hatch, Springville, UT (US); Judith Palmer, Lehi, UT (US)

(73) Assignee: Purple Innovation, LLC, Lehi, UT (US)

( * ) Notice: Subject to any disclaimer, the term of this patent is extended or adjusted under 35 U.S.C. 154(b) by 603 days.

(21) Appl. No.: 17/521,604

(22) Filed: Nov. 8, 2021

(65) Prior Publication Data

US 2022/0142383 A1 May 12, 2022

Related U.S. Application Data

(60) Provisional application No. 63/110,936, filed on Nov. 6, 2020.

(51) Int. Cl.
*A47G 9/10* (2006.01)

(52) U.S. Cl.
CPC ..... *A47G 9/10* (2013.01); *A47G 2009/1018* (2013.01); *A47G 9/1045* (2013.01)

(58) Field of Classification Search
CPC ..... A47G 9/10; A47G 2009/1018; A47G 9/0253; A47G 9/109; A47G 2009/003;
(Continued)

(56) References Cited

U.S. PATENT DOCUMENTS

2008/0235877 A1* 10/2008 Murray ..... A47G 9/10 5/636
2018/0184820 A1 7/2018 Johnson
(Continued)

FOREIGN PATENT DOCUMENTS

CN 211459661 U 9/2020
EP 2036460 B1 * 5/2010 ..... A47G 9/10
(Continued)

OTHER PUBLICATIONS

USPTO acting as International Searching Authority, "International Search Report and Written Opinion," Application No. PCT/US2021/058461, Feb. 7, 2022.
(Continued)

*Primary Examiner* — Justin C Mikowski
*Assistant Examiner* — Deborah Talitha Gedeon
(74) *Attorney, Agent, or Firm* — Foley & Lardner LLP

(57) ABSTRACT

A pillow with variable cushioning characteristics includes two halves, with each half including a first surface, a first cushioning material adjacent to the first surface, a second surface opposite from the first surface, and a second cushioning material adjacent to the second surface. The halves may be associated with one another in such a way that an individual may select which cushioning material is to be oriented adjacent to an outside of the pillow and which cushioning material is to be oriented within an interior of the pillow. Methods of arranging a pillow with such variable cushioning characteristics are also disclosed.

17 Claims, 6 Drawing Sheets

(58) Field of Classification Search
CPC .. A47G 9/1009; A47G 9/1045; A47G 9/1072; A47G 9/1081; A47G 9/1036; A47G 9/1027; A47G 9/1054; A47G 9/1063; A61G 7/072
USPC ..... 5/490, 636, 645
See application file for complete search history.

(56) References Cited

U.S. PATENT DOCUMENTS

| | | | | |
|---|---|---|---|---|
| 2018/0325291 | A1* | 11/2018 | Holbrook | A47G 9/04 |
| 2019/0133349 | A1 | 5/2019 | Fux | |

FOREIGN PATENT DOCUMENTS

| | | | | | |
|---|---|---|---|---|---|
| JP | H10257952 | A | | 9/1998 | |
| JP | 2000-060704 | | | 2/2000 | |
| JP | 2000060704 | A | * | 2/2000 | |
| JP | 2018-000617 | | | 1/2018 | |
| KR | 20180070215 | A | * | 6/2018 | A47G 9/10 |

OTHER PUBLICATIONS

Korean Intellectual Property Office, "Notice of Preliminary Rejection," Korean Patent Application No. 10-2023-7017142, May 21, 2024.

* cited by examiner

PILLOW WITH VARIABLE CUSHIONING CHARACTERISTICS

CROSS-REFERENCE TO RELATED APPLICATION

A claim for the benefit of priority to the Nov. 6, 2020 filing date of U.S. Provisional Patent Application No. 63/110,936, titled PILLOW WITH VARIABLE CUSHIONING CHARACTERISTICS ("the '936 Provisional Application") is hereby made pursuant to 35 U.S.C. § 119(e). The entire disclosure of the '936 Provisional Application is hereby incorporated herein.

TECHNICAL FIELD

This disclosure relates generally to pillows with variable cushioning characteristics. More specifically, this disclosure relates to a pillow that include two halves, with each half including a first surface and a second surface opposite from the first surface. The halves may be associated with one another in such a way that an individual may select a softness or firmness of the pillow by selecting which surface (s) is (are) to be oriented adjacent to an outside of the pillow and which surface(s) is (are) to be oriented toward a center, or within an interior, of the pillow. Methods of arranging a pillow with such variable cushioning characteristics are also disclosed.

SUMMARY

In one aspect, this disclosure relates to a pillow with variable cushioning characteristics. In various embodiments, such a pillow includes two halves, each of which may be referred to as a "half" or a "pillow half" Each half of the pillow may include a first surface and a second surface, between which an interior of the pillow half is defined.

A cushioning material, such as a fill material, a cushioning element, or the like, may be placed in the interior of each half. In some embodiments, a plurality of cushioning materials may be placed in each half; for example, a first cushioning material may be positioned within the interior of the pillow half, adjacent to the first surface of the pillow half, while a second cushioning material may be positioned within the interior of the pillow half, adjacent to the second surface.

In embodiments where a plurality of cushioning materials are positioned at different discrete locations within in interior of at least one half of the pillow, an intermediate layer may extend across the interior of that half of the pillow. The intermediate layer may separate the interior of its respective pillow half into a first interior portion and a second interior portion, with the first interior portion being located between the intermediate layer and the first surface of the pillow half and the second interior portion being located between the intermediate layer and the second surface of the pillow half. The intermediate layer may include one or more pleats, which may enable it to be moved in a manner that adjusts the volumes of the first interior portion and the second interior portion without substantially changing a collective volume of the interior of the pillow half. Regardless of the configuration of the intermediate layer, the first interior portion of the pillow half may carry the first cushioning material, while the second interior portion of the pillow half may carry the second cushioning material.

In embodiments where an interior of at least one half of the pillow contains at least two cushioning materials at discrete locations, the first cushioning material may comprise a soft material, such as a conventional fill for a pillow. Examples of soft fill materials include, but are not limited to polyester fibers, down, feathers, particles of low density foam rubber, or the like. The first cushioning material may comprise a down-like synthetic material. In a specific embodiment, the first cushioning material may comprise a siliconized polyester fiber. Such materials may impart a first side of the pillow half with a soft and immersive loft.

In embodiments where an interior of at least one half of the pillow contains at least two cushioning materials at discrete locations, the second cushioning material may comprise a relatively firm material, such as an elastomeric material or a fill that comprises an elastomeric material. In some embodiments, the second cushioning material may include fibers formed from an elastomeric gel, such as an unopened blown elastomeric gel fiber. Some other non-limiting examples of such a material include particles of rubber, more specifically, particles of a closed cell foamed rubber, or even more specifically, particles of ethylene vinyl acetate (EVA) foam rubber. Such materials may impart a second side of the pillow half with firmness and stable support.

In other embodiments, each half of the pillow may lack an intermediate layer and include a single type or a single mixture of fill and/or cushioning materials. In such embodiments, each half of the pillow may include the same type or mixture of fill and/or cushioning materials. Alternatively, each half of the pillow may include a different type or mixture of fill and/or cushioning materials than the other half of the pillow.

A first peripheral edge of the first pillow half and a first peripheral edge of the second pillow half may be flexibly coupled to one another along a flexible connector (e.g., a sewn seam, a fabric gusset, etc.,) between the first peripheral edges, while a second peripheral edge of the first pillow half and a second peripheral edge of the second pillow half may be reversibly coupled to one another with a coupler (e.g., complementary zipper halves, buttons, snaps, etc.). One or both of the flexible connector and the coupler may be secured to its respective peripheral edge at a location that is offset from a center of the height of that peripheral edge.

In such embodiments, the pillow has a partially disassembled arrangement when the second peripheral edges of the first pillow half and the second pillow half are uncoupled from one another. In the partially disassembled arrangement, the first pillow half and the second pillow half may be laid side-by-side. An individual may the determine which sides of the pillow halves will be positioned on the outside of the pillow, fold the pillow accordingly along the flexible connector to superimpose the first half and the second half, and couple the second peripheral edges of the first pillow half and the second pillow half to hold the pillow in an assembled arrangement. Positions of the flexible connector and/or elements of the coupler along the heights of their respective peripheral edges of each half of the pillow may enable the pillow to assume a first arrangement in which the pillow is relatively soft and exhibits immersive loft for a supported object, such as a head or another body part of an individual, and a second arrangement in which the pillow is relatively form and provides stable support for the supported object. Thus, the relative orientations of the halves, may at least partially determine whether the pillow is soft or firm, even in embodiments where each half carries a single type or a single mixture of fill and/or cushioning materials. In embodiments where each half of the pillow includes different cushioning materials on opposite sides thereof, the orientation of each side may at least partially determine whether the pillow is soft or firm.

In other embodiments, the first peripheral edges of the first pillow half and the second pillow half may be reversibly coupled to one another and the second peripheral edges of the first pillow half and the second pillow half may be reversibly coupled to one another. Such a pillow may have a completely disassembled arrangement, in which the first pillow half and the second pillow half are completely separate from one another, as well as a partially disassembled arrangement, in which the first pillow half and the second pillow half may be positioned side-by side. In such embodiments, an individual may determine which pillow half is to be positioned on top of the pillow, which cushioning material is to be placed adjacent to an upper surface of the pillow, and which cushioning material is to be placed on a bottom surface the pillow. The individual may then arrange and superimpose the first pillow half and the second pillow half accordingly, couple the first peripheral edges of the first pillow half and the second pillow half, and couple the second peripheral edges of the first pillow half and the second pillow half to place the pillow into an assembled arrangement.

In still other embodiments, the first peripheral edges of the first pillow half and the second pillow half may be flexibly coupled together along a flexible connector (e.g., a sewn seam, a fabric gusset, etc.) and the second peripheral edges of the first pillow half and the second pillow half may be flexibly coupled together along a flexible connector. The first half and the second half of such a pillow are always in an assembled relationship, with the first half and the second half superimposed relative to one another. Such a pillow may be rearranged, however, by pulling the first half and the second half through a center between the first half and the second half, enabling an individual to determine which surfaces of the first pillow half and the second pillow half will define an outside of the pillow, which cushioning material will be oriented toward the outside of the pillow, which surfaces of the first pillow half and the second pillow half will define the center of the pillow, and which cushioning material will be positioned adjacent to the center of the pillow.

Methods for adjusting a pillow to provide a desired cushioning effect are also disclosed, and should be apparent from the foregoing disclosure.

Other aspects of the disclosed subject matter, as well as features and advantages of various aspects of the disclosed subject matter, should be apparent to those of ordinary skill in the art through consideration of the preceding disclosure, the ensuing description, the accompanying drawings, and the appended claims.

DETAILED DESCRIPTION

Figure 1:
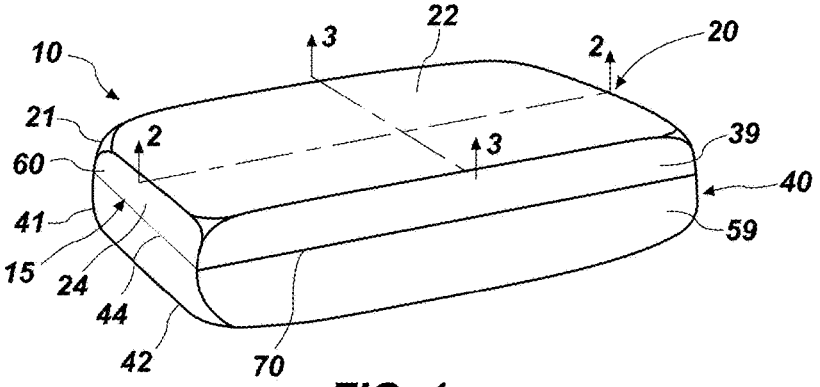
FIGS. 1 and 1A are perspective views of a pillow according to this disclosure in a first arrangement, in which the pillow is softer and provides immersive loft for a supported object, such as a head or another body part of an individual.
Figure 1A:
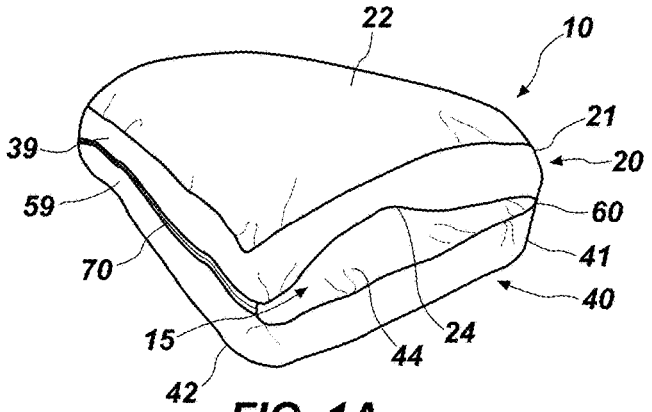

An embodiment of a pillow 10 according to this disclosure is shown in FIGS. 1 and 1A. The pillow 10 includes a first half 20 and a second half 40 that may be oriented in a plurality of arrangements. Each of the first half 20 and the second half 40 may be referred to herein as a "half." Together, the first half 20 and the second half 40 may be referred to as "halves." The first half 20 and second half 40 may be flexibly secured to each other by way of a flexible connector 60. In addition, the pillow 10 may include a coupler 70 that secures the first half 20 and the second half 40 to each other in a desired arrangement.

Figure 2:
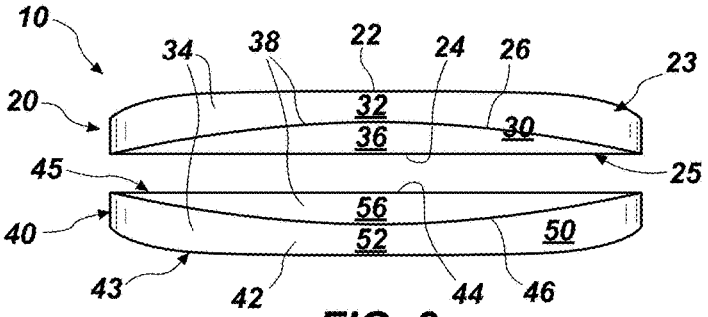
FIG. 2 depicts a cross-section of an embodiment of the pillow shown in FIG. 1, taken along line 2-2.
Figure 3:
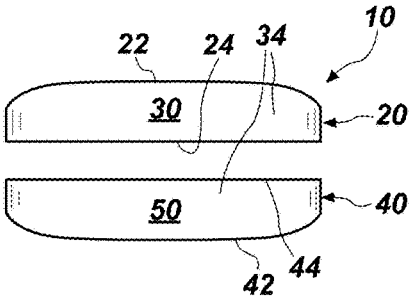
FIG. 3 depicts a cross-section of the embodiment of the pillow shown in FIG. 2, taken along line 3-3 of FIG. 1.
Figure 4:
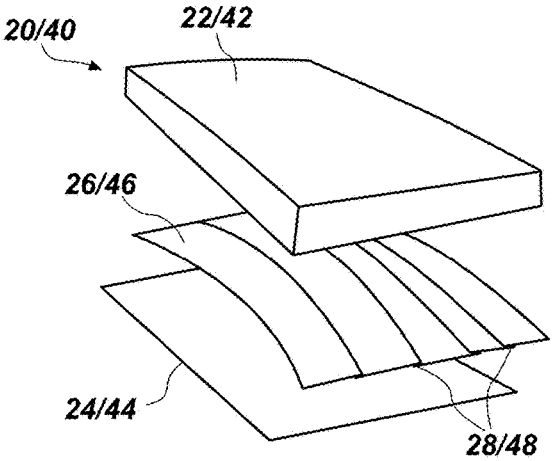
FIG. 4 is an exploded perspective view of a half of the embodiment of the pillow shown in FIGS. 2 and 3, omitting the fill materials of the pillow half.

With added reference to FIGS. 2-4, each half 20, 40 of the pillow 10 includes a first surface 22, 42 and a second surface 24, 44. An interior 30, 50 of each half 20, 40 may be defined between the first surface 22, 42 and the second surface 24, 44. The interior 30, 50 of the pillow may receive a cushioning material 34, 38.

With continuing reference to FIGS. 1 and 1A, in some embodiments, the flexible connector 60 and the coupler 70 may be positioned at locations along the heights of their respective peripheral edges 21, 41 and 39, 59 of the halves 20 and 40 of the pillow 10 in a manner that enables an individual to selectively impart the pillow 10 with softness or firmness. More specifically, the flexible connector and the coupler 70 may be positioned closer to the second surface 24, 44 of each half 20, 40 than to the first surface 22, 42 of each half 20, 40. Thus, when the pillow 10 is in the first arrangement depicted by FIGS. 1 and 1A, with the first surfaces 22 and 42 of the halves 20 and 40 facing outward and the second surfaces 24 and 44 of the halves 20 and 40 facing inward (and each other), effective volumes of the interiors 30 and 50 (FIGS. 2 and 3) of the halves 20 and 40 may be maximized. With the effective volumes of the interiors 30 and 50 maximized, the cushioning material 34, 38 therein may be able to flow somewhat, imparting the pillow 10 with a soft feel and sufficient loft to enable a head or another body part of an individual to sink into, or be immersed into, the pillow. Alternately, when the pillow 10 is in the second arrangement depicted by FIGS. 15 and 15A, with the second surfaces 24 and 44 of the halves 20 and 40 facing outward and the first surfaces 22 and 42 of the halves 20 and 40 facing inward (and each other), the locations of the flexible connector 60 and the coupler 70 may restrict expansion of the first surfaces 22 and 42 and adjacent portions of their corresponding peripheral edges, reducing the effective volumes of the interiors 30 and 50 of the halves 20 and 40. As the effective volumes of the interiors 30 and 50 are reduced, the cushioning material 34, 38 therein is compressed, imparting the pillow 10 with a firmer feel, enabling the pillow 10 to more stably support a head or other body part of an individual.

In some embodiments, each half 20, 40 of the pillow 10 may include an undivided interior. The undivided interior may carry a single type or a single mixture of fill and/or cushioning material(s) (i.e., the cushioning materials may be the same). In such embodiments, both halves 20 and 40 of the pillow 10 may include the same type or mixture of fill and/or cushioning material(s). Alternatively, each half 20, 40 of the pillow 10 may include a different type or mixture of fill and/or cushioning material(s) than the type or mixture of fill and/or cushioning material(s) of the other half 40, 20 of the pillow 10. Each half 20, 40 of the pillow 10 may include any type or mixture of fill and/or cushioning material(s) suitable for use in a pillow.

In other embodiments, such as that depicted by FIGS. 2 and 4, an intermediate layer 26, 46 may extend across the interior 30, 50 of at least one half 20, 40 of the pillow 10. The intermediate layer 26, 46 may separate the interior 30, 50 into a first interior portion 32, 52 and a second interior portion 36, 56. The first interior portion 32, 52 may be located between the intermediate layer 26, 56 and the first surface 22, 42 of its respective half 20, 40, defining a first side 23, 43 of the half 20, 40. The second interior portion 36, 56 may be located between the intermediate layer 26, 46 and the second surface 24, 44 of the half 20, 40, defining a second side 25, 45 of the half 20, 40.

The intermediate layer 26, 46 may have a configuration that may enable it to be moved in a manner that adjusts the volumes of the first interior portion 32, 52 and the second interior portion 36, 56 without substantially changing a collective volume of the interior 30, 50 of its respective half 20, 40. In some embodiments, such as that depicted by FIG. 4, the intermediate layer 26, 46 may include pleats 28, 48. The pleats 28, 48 may be oriented to enable the intermediate layer 26, 46 to expand and contract toward a center of the half 20, 40 of the pillow 10. As illustrated, the pleats 28, 48 may be oriented to enable the intermediate layer 26, 46 to expand toward the first surface 22, 42 of the half 20, 40 and contract toward the second surface 24, 44 of the half 20, 40. Each pleat 28, 48 may be oriented to open toward a center of the intermediate layer 26, 46. The pleats 28, 48 may extend along a length of the intermediate layer 26, 46 and, thus, along a length (i.e., from side to side) of the half 20, 40 of the pillow 10, as shown, or they may extend along a height of the intermediate layer 26, 46 and, thus, along a height (i.e., from top to bottom) of the half 20, 40 of the pillow 10 or diagonally across the intermediate layer 26, 46. In a specific embodiment, each pleat 28, 48 may be formed from about a half inch (about 1.25 cm) of the material from which the intermediate layer 26, 46 is formed and, thus, include a quarter inch (about 0.675 cm) overlap.

With returned reference to FIG. 2, a configuration of the intermediate layer 26, 46 may enable it to be positioned such that each of the first interior portion 32, 52 and the second interior portion 36, 56 makes up as little as about 5% of a volume of the interior 30, 50 of the half 20, 40 and as much as about 95% of a volume of the interior 30, 50. Thus, without limitation and as shown in FIG. 2, the intermediate layer 26, 46 may be positioned in such a way that a volume of the first interior portion 32, 52 is about one-third of the total volume of the interior 30, 50 of the half 20, 40, while a volume of the second interior portion 36, 56 is about two-thirds of the total volume of the interior 30, 50 of the half 20, 40. As another example, the intermediate layer 26, 46 may be positioned such that it divides the interior 30, 50 of the half 20, 40 substantially in half, with the volumes of the first interior portion 32, 52 and second interior portion 36, 56 being about the same (i.e., each about 50% of the volume of the interior 30, 50).

Figure 5:
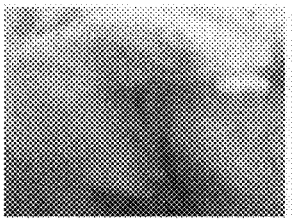
FIG. 5 is an image of an embodiment of a first fill material of the pillow half shown in FIGS. 2 and 3.

The first interior portion 32, 52 of the first side 23, 43 of the half 20, 40 of the pillow 10 may carry a first cushioning material 34. The first cushioning material 34 may comprise a soft material, such as a conventional fill for a pillow. Without limitation, such a first cushioning material may have a density of less than 1 g/cm$^3$. Examples of first cushioning materials 34 include but are not limited to polyester fibers, down, down-like synthetic materials, feathers, particles of low density foam rubber, and the like. More specifically, the first cushioning material 34 may comprise a siliconized polyester fiber, as depicted by FIG. 5. In some embodiments, the soft fill material (e.g., the siliconized polyester fiber, etc.) may have a density of 0.9 g/cm$^3$ or less. As an alternative or in addition to comprising a fill material, the first cushioning material 34 may comprise a unitary cushioning element. The first cushioning material 34 may impart the first side 23 of the first half 20 with a soft and immersive loft (i.e., an individual's head or another body part may be able to sink into the first side 23 of the first half 20 of the pillow 10).

Figure 6:
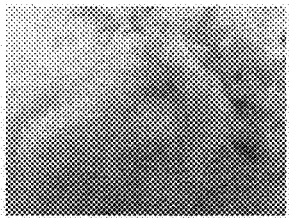
FIG. 6 is an image of an embodiment of a second fill material of the pillow half shown in FIG. 2.

The second interior portion 36, 56 of the second side 25, 45 of the half 20, 40 of the pillow 10 may carry a second cushioning material 38. The second cushioning material 38 may comprise a relatively firm material; a firmness, a hardness, and/or a density of the second cushioning material 38 may exceed a firmness, a hardness, and/or a density of the first cushioning material 34. Without limitation, the second cushioning material 38 may have a density of 1 g/cm$^3$ or more. The second cushioning material 38 may include an elastomeric material or a fill that comprises an elastomeric material. Some non-limiting examples of fills that comprise elastomeric materials include particles of rubber, more specifically, particles of closed cell foamed rubber, or even more specifically, particles of ethylene vinyl acetate (EVA) foam rubber. In some embodiments, the second cushioning material 38 may include fibers formed from an elastomeric gel (e.g., an extended A-B-A triblock copolymer, such as those disclosed by U.S. Pat. Nos. 6,413,458, 6,797,765 and 7,964,664, the entire disclosures of which are hereby incorporated herein; a silicone elastomer gel; a polyurethane elastomer gel; etc.). In a specific embodiment, the second cushioning material 38 may comprise a blown dense gel fiber, as depicted by FIG. 6. In some embodiments, the elastomeric material (e.g., the blown dense gel fiber, etc.) may have a density of about 1.5 g/cm$^3$ or more. As an alternative or in addition to comprising a fill material, the second cushioning material 38 may comprise a unitary cushioning element. The second cushioning material 38 may impart the second side 25 of the first half 20 of the pillow 10 with a firmness that will provide stable support to an individual's head or another body part.

With returned reference to FIG. 2, in a specific embodiment, the first interior portion 32, 52 of the first side 23, 43 of the half 20, 40 of the pillow 10 may carry about 6 ounces (about 170 g) of a first cushioning material 34 that comprises a siliconized polyester fiber having a density of about 0.9 g/cm$^3$, while the second interior portion 36, 56 of the second side 25, 45 of the half 20, 40 of the pillow 10 may carry about 17 ounces (about 480 g) of a second cushioning material 38 that comprises unopened blown fibers of elastomeric gel having a density of about 1.5 g/cm$^3$. Of course, other amounts, densities, and materials of one or both of the first cushioning material 34 and the second cushioning material 38 may be included in each half 20, 40 of a pillow 10 of this disclosure.

While, in some embodiments, the first cushioning material 34 and second cushioning material 38 may be different from one another, in other embodiments the first cushioning material 34 and second cushioning material 38 may be comprised of the same material.

As shown in FIG. 2, the first half 20 and second half 40 of the pillow 10 may be configured the same. Alternatively, a configuration of the second half 40 may differ from the configuration of the first half 20. For example, an interior (not shown) of the second half 40 may be undivided and/or contain a single cushioning material or a mixture of cushioning materials. As another option, the cushioning material (s) 34, 38 may differ from the first half 20 to the second half 40.

FIGS. 1 and 1A show the pillow 10 in the first arrangement, in which the first half 20 and second half 40 of the pillow 10 are arranged such that their first surfaces 22 and 42, respectively, define oppositely facing outer surfaces 12 and 14 of the pillow 10 and their second surfaces 24 and 44, respectively, face, or oppose, one another, defining a center 15 of the pillow 10.

In embodiments where each half 20, 40 includes a first cushioning material 34 and second cushioning material 38 that differ from each other, in the first arrangement, the first cushioning material 34 may be located adjacent to the outer surfaces 12 and 14 of the pillow 10, imparting the outer portions of the pillow 10 with softness and immersive loft, while the firmer second cushioning material 38 may be confined to the interior of the pillow 10.

Figure 7:
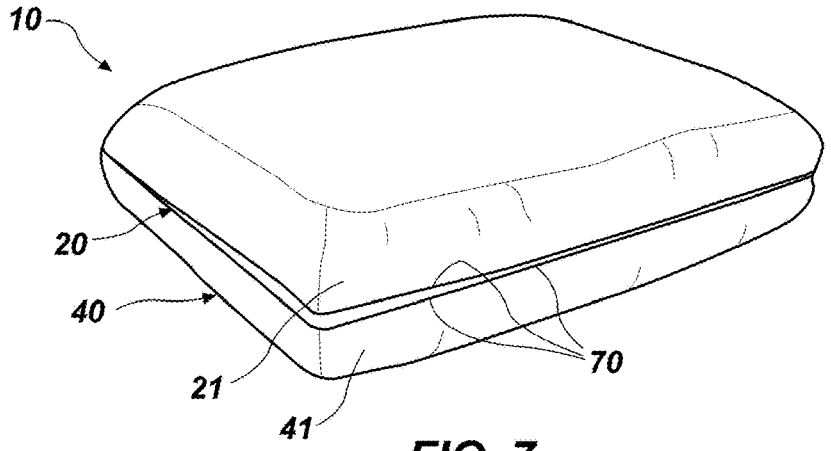
FIGS. 7-14 show the pillow illustrated by FIGS. 1 and 1A in various partially disassembled, completely disassembled, and partially re-assembled orientations, in which halves of the pillow are separated from the first arrangement shown in FIGS. 1 and 1A and secured in a second arrangement.
Figure 8:
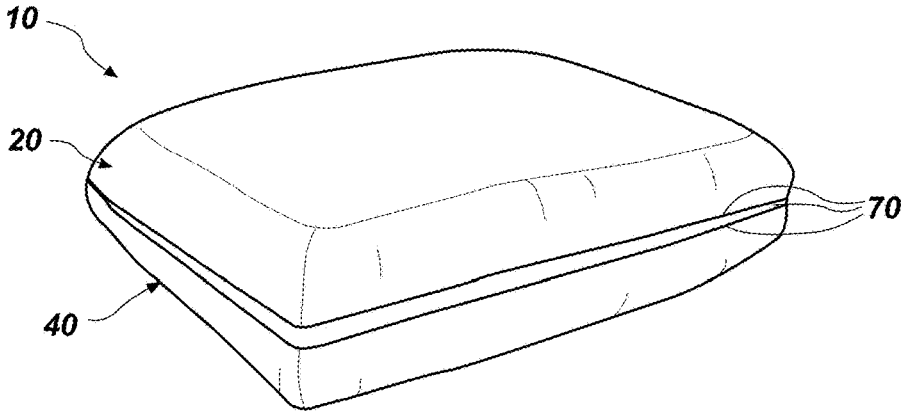
Figure 9:
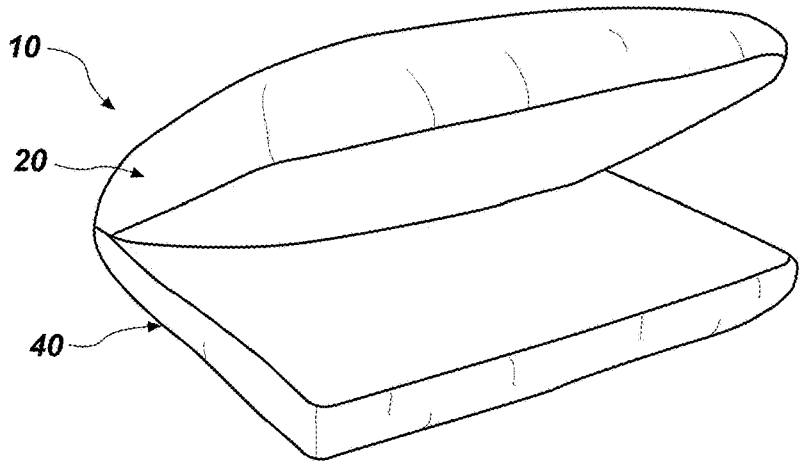
Figure 10:
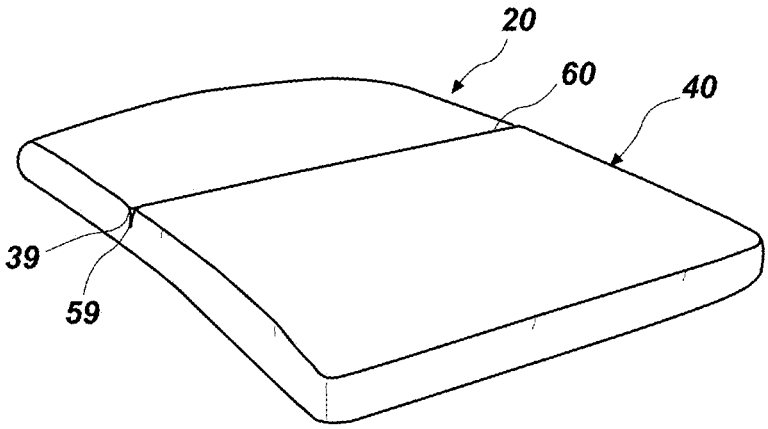
Figure 11:
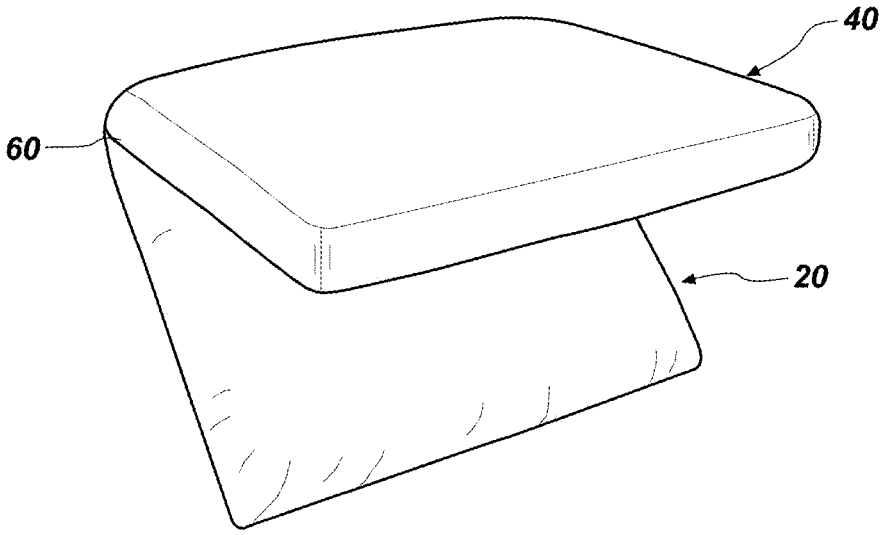
Figure 12:
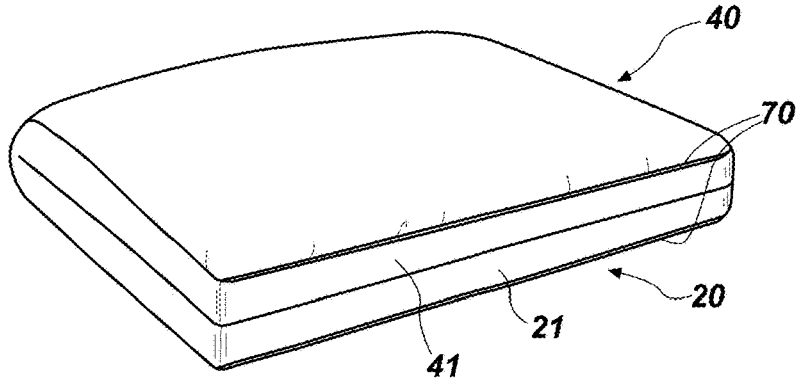
Figure 13:
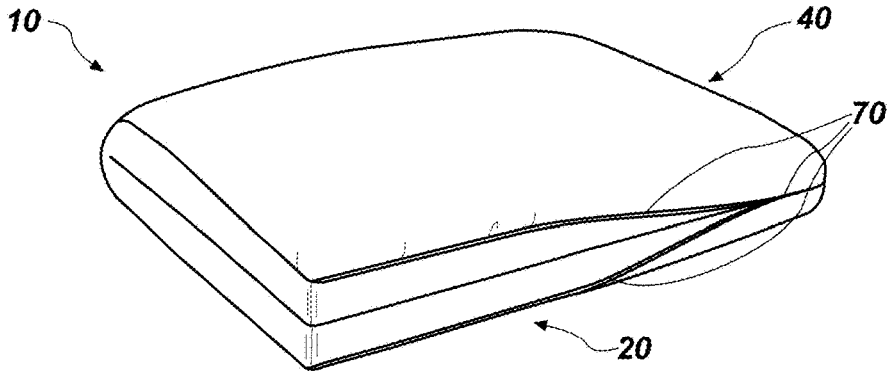
Figure 14:
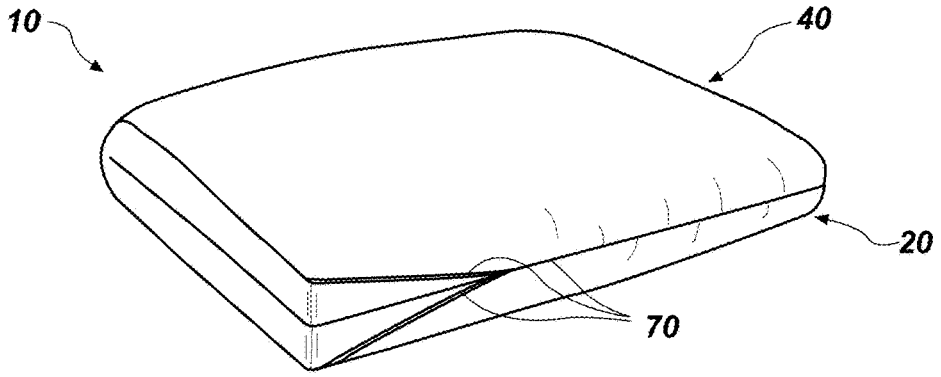

Regardless of the cushioning material(s) 34, 39 included in each half 20, 40 of the pillow 10, the arrangement of the pillow 10 may, when desired, be changed, as depicted by FIGS. 7-14. In FIGS. 7 and 8, a coupler 70, such as a zipper or any other suitable closure, may be uncoupled to enable peripheral edges 21 and 41 of the first half 20 and the second half 40, respectively, to be separated from each other, as shown in FIG. 9. The first half 20 and second half 40 may then be removed from the first superimposed relationship shown in FIGS. 1 and 7-9 and placed in an unfolded, or open, orientation, as shown in FIG. 10. Without limitation, the first half 20 and second half 40 may be unfolded about a flexible connector 60, which may secure peripheral edges 39 and 59 of the first half 20 and the second half 40, respectively, together. The first half 20 and second half 40 may then be superimposed in the opposite manner, or placed in a second superimposed relationship. Without limitation, the first half 20 and second half 40 may be folded in the opposite direction about the flexible connector 60, as shown in FIG. 11. With the first half 20 and second half 40 in the second superimposed relationship shown in FIG. 12, the coupler 70 may be recoupled, as illustrated by FIGS. 13 and 14, securing the pillow 10 in a second arrangement.

Figure 15:
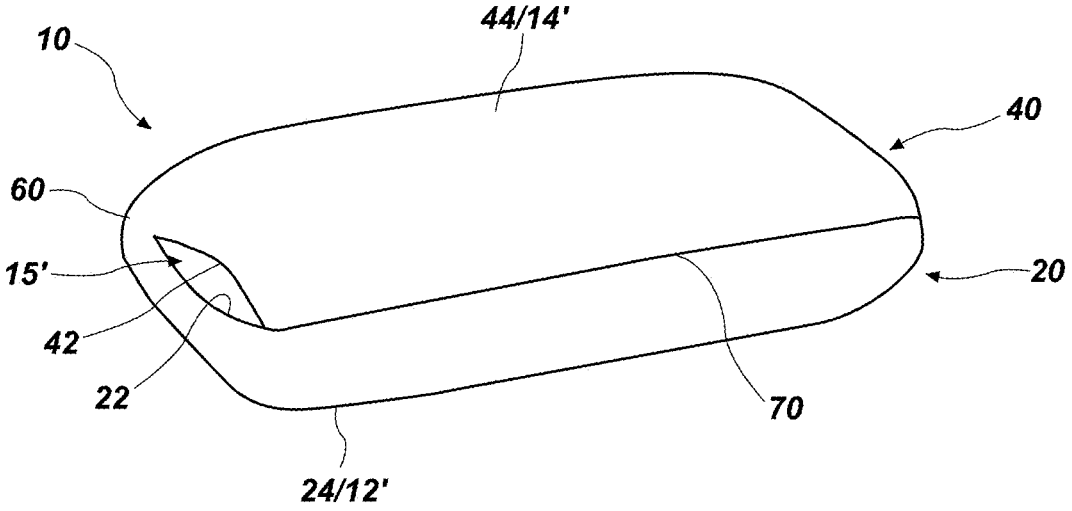
FIGS. 15 and 15A are perspective views of the embodiment of the pillow shown in FIGS. 1 and 1A in the second arrangement.
Figure 15A:
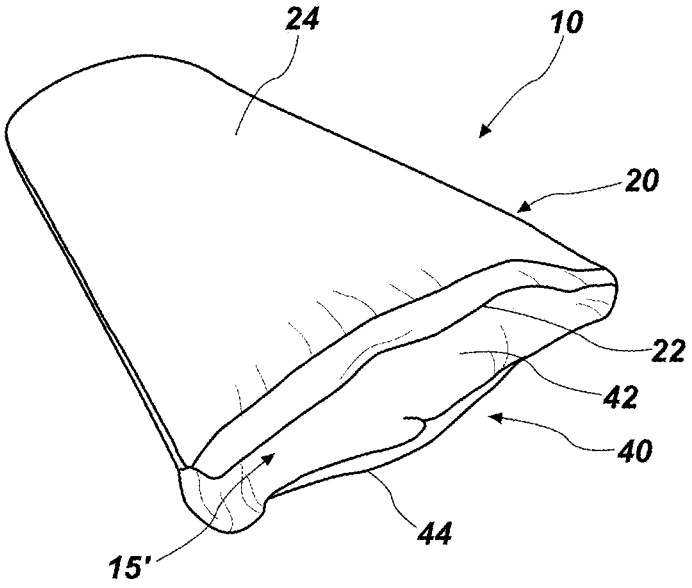

FIGS. 15 and 15A show the pillow 10 in the second arrangement, in which the first half 20 and second half 40 of the pillow 10 are arranged such that their second surfaces 24 and 44, respectively, define oppositely facing outer surfaces 12' and 14' of the pillow 10 and their first surfaces 22 and 42, respectively, face, or oppose, one another, defining a center 15' of the pillow 10. Depending upon the positioning of the flexible connector 60 and the coupler 70 (their locations along the heights of the peripheral edges 21 and 41 and the peripheral edges 39 and 59 (FIG. 12) of the first half 20 and second half 40, respectively, a thickness of the pillow 10 may differ from its first arrangement depicted by FIGS. 1 and 1A to its second arrangement depicted by FIGS. 15 and 15A. In a specific embodiment, an uncompressed thickness of the pillow 10 in the first arrangement may be about 8 inches (about 200 mm), while an uncompressed thickness of the pillow 10 in the second arrangement may be about 7 inches (about 175 mm). It will be appreciated that the thickness of the pillow 10 may vary depending on the thickness and volume of the interior of each half 20, 40 of the pillow and/or the uncompressed volume of cushioning material within each half 20, 40 of the pillow 10. Without limitation, thicknesses of about 1 inch (about 25 mm) to about 10 inches (about 254 mm) are contemplated as being within the scope of this disclosure.

In embodiments where each half 20, 40 of the pillow 10 includes cushioning materials 34 and 38 that differ from each other, in the second arrangement, the denser second cushioning material 38 may be located adjacent to the outer surfaces 12' and 14' of the pillow 10, imparting the outer portions of the pillow with firmness and stable supportiveness, while the less dense first cushioning material 34 is confined to the interior of the pillow 10.

Figure 16:
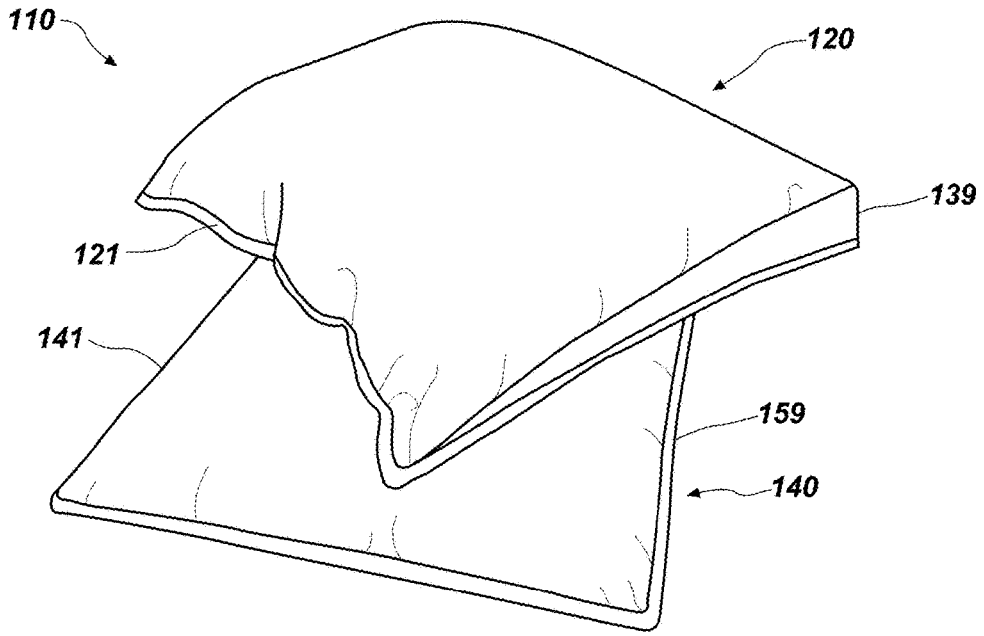
FIG. 16 is a perspective view of another embodiment of a pillow according to this disclosure, showing first and second halves of the pillow in an unassembled relationship.
Figure 17:
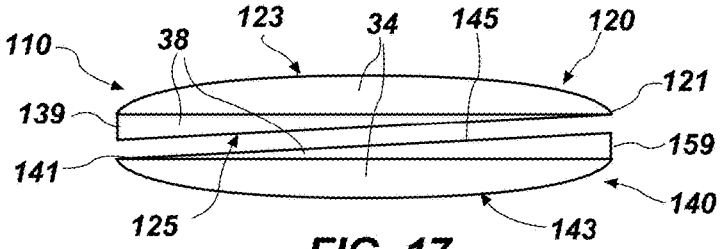
FIG. 17 is a cross-sectional representation of the embodiment of the pillow shown in FIG. 16.

Turning now to FIGS. 16 and 17, another embodiment of a pillow 110 according to this disclosure is illustrated. The pillow 110 includes a first half 120 and a second half 140. Each of the first half 120 and the second half 140 may be referred to herein as a "half." Together, the first half 120 and the second half 140 may be referred to as "halves." Each half 120, 140 may have a tapered, or wedge, shape, being thinner along a first peripheral edge 121, 141 and thicker along a second peripheral edge 139, 159, with the first peripheral edge 121, 141 and the second peripheral edge 139, 159 being opposite from one another. As illustrated by FIG. 17, a first side 123, 143 of each half 120, 140 of the pillow 110 may carry, or contain, the first cushioning material 34, while a second side 125, 145 of each half 120, 140 of the pillow 110 may carry, or contain, the second cushioning material 38.

Figure 18:
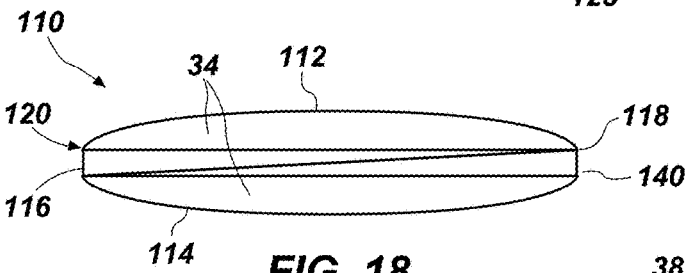
FIGS. 18-20 show various arrangements of the first and second halves of the embodiment of the pillow illustrated by FIGS. 16 and 17.

FIG. 18 depicts an arrangement in which the halves 120 and 140 are positioned such that the first side 123, 143 of each half 120, 140 faces outwardly and the second side 125, 145 of each half 120, 140 faces inwardly (i.e., they face each other). Thus, the softer first cushioning material 34 is positioned adjacent to the outer surfaces 112 and 114 of the pillow 110. In addition, opposite peripheral edges 116 and 118 of the pillow 110, which are defined by the first peripheral edge 121 (FIG. 17) of the first half 120 and the second peripheral edge 159 (FIG. 17) of the second half and by the second peripheral edge 139 (FIG. 17) of the first half 120 and the first peripheral edge 141 (FIG. 17) of the second half 140, respectively, have substantially the same heights.

Figure 19:
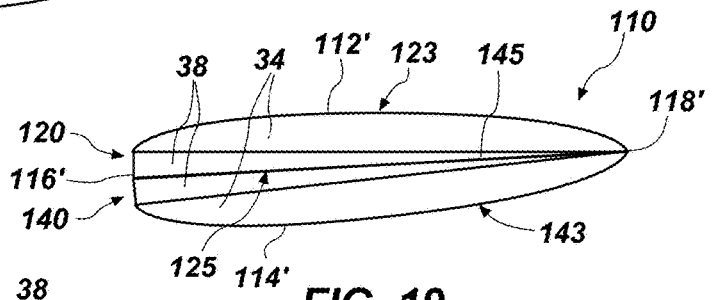

FIG. 19 depicts an arrangement in which the halves 120 and 140 are positioned such that the first side 123, 143 of each half 120, 140 faces outwardly and the second side 125, 145 of each half 120, 140 faces inwardly (i.e., they face each other). Thus, the softer first cushioning material 34 is positioned adjacent to the outer surfaces 112' and 114' of the pillow 110. In addition, a height of one peripheral edge 116' of the pillow 110, which peripheral edge 116' is defined by the second peripheral edge 139 (FIG. 7) of the first half 120 and the second peripheral edge 159 (FIG. 7) of the second half 140, exceeds a height of an opposite peripheral edge 118' of the pillow 110, which peripheral edge 118' is defined by the first peripheral edge 121 (FIG. 7) of the first half 120 and the first peripheral edge 141 (FIG. 7) of the second half 140.

Figure 20:
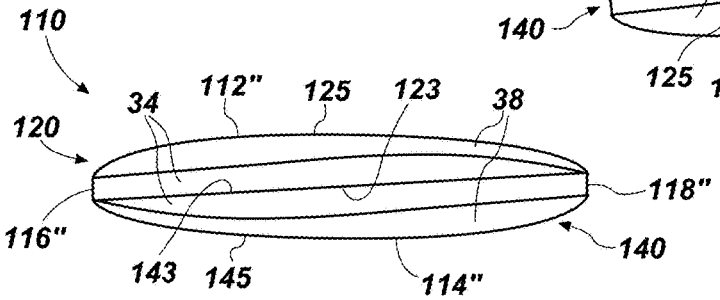

FIG. 20 depicts an arrangement in which the halves 120 and 140 are positioned such that the second side 125, 145 of each half 120, 140 faces outwardly and the first side 123, 143 of each half 120, 140 faces inwardly (i.e., they face each other). Thus, the firmer second cushioning material 38 is positioned adjacent to the outer surfaces 112" and 114" of the pillow 110. In addition, opposite peripheral edges 116" and 118" of the pillow 110, which are defined by the first peripheral edge 121 (FIG. 7) of the first half 120 and the second peripheral edge 159 (FIG. 7) of the second half 140 and by the second peripheral edge 139 (FIG. 7) of the first half 120 and the first peripheral edge 141 (FIG. 7) of the second half 140, respectively, have substantially the same heights.

Of course, other arrangements that impart the pillow 110 with softnesses or firmnesses and/or different shapes or configurations are also within the scope of this disclosure.

Although this description provides many specifics, these should not be construed as limiting the scopes of the inventions recited by any of the appended claims, but merely as providing information pertinent to some specific embodiments that may fall within the scopes of the appended claims. Features from different embodiments may be employed in combination. In addition, other embodiments may also lie within the scopes of the appended claims. All additions to, deletions from and modifications of the disclosed subject matter that fall within the scopes of the claims are to be embraced by the claims.

What is claimed:

1. A pillow, comprising:

a first half including:

a first surface;

a second surface;

a first half interior defined between the first surface of the first half and the second surface of the first half;

a first cushioning material positioned within the first half interior, adjacent to the first surface of the first half; and a second cushioning material positioned within the first half interior, adjacent to the second surface of the first half;

a second half including:

a first surface;

a second surface;

a second half interior defined between the first surface of the second half and the second surface of the second half;

a first cushioning material positioned within the second half interior, adjacent to the first surface of the second half;

a second cushioning material positioned within the second half interior, adjacent to the second surface of the second half; and a center defined between the first half and the second half upon superimposing the first half and the second half with respect to one another, the pillow having:

a first assembled arrangement in which the first half and the second half are superimposed with one another, the first surface of the first half and the first surface of the second half facing one another and defining the center of the pillow, and the pillow has a first loft; and a second assembled arrangement in which the first half and the second half are superimposed with one another, the second surface of the first half and the second surface of the second half facing one another and defining the center of the pillow, and the pillow has a second loft different from the first loft.

2. The pillow of claim 1, wherein the first half includes a first peripheral edge and a second peripheral edge, the second half includes a first peripheral edge and a second peripheral edge.

3. The pillow of claim 2, further comprising:

a flexible connector between first peripheral edge of the first half and the first peripheral edge of the second half; and a coupler that selectively couples the second peripheral edge of the first half to the second peripheral edge of the second half.

4. The pillow of claim 3, wherein the coupler selectively maintains the pillow in one of the first assembled arrangement and the second assembled arrangement.

5. The pillow of claim 3, having:

a partially disassembled arrangement in which the first half and the second half are positionable in a side-by-side arrangement.

6. The pillow of claim 5, wherein the first half and the second half have sufficient flexibility to enable the first and the second half to be pulled through the center to move the pillow between the first assembled arrangement and the second assembled arrangement.

7. The pillow of claim 2, wherein the first half and the second half have a completely disassembled relationship in which:

the first peripheral edge of the first half and the first peripheral edge of the second half are uncoupled and the second peripheral edge of the first half and the second peripheral edge of the second half are uncoupled.

8. The pillow of claim 7, wherein:

the first peripheral edge of the first half can be coupled to the second peripheral edge of the second half and the second peripheral edge of the first half can be coupled to the first peripheral edge of the second half to place the pillow in:

a first alternative assembled arrangement in which the first surface of the first half faces the second surface of the second half or a second alternative assembled arrangement in which the second surface of the first half faces the first surface of the second half.

9. The pillow of claim 1, wherein the first cushioning material is softer than the second cushioning material.

10. The pillow of claim 1, wherein at least one of the first cushioning material and the second cushioning material comprises a fill material.

11. The pillow of claim 1, wherein the first half comprises an intermediate layer between the first surface of the first half and the second surface of the first half, the intermediate layer defining a first interior portion between the intermediate layer and the first surface of the first half and a second interior portion between the intermediate layer and the second surface of the first half, and separating the first cushioning material within the first interior portion from the second cushioning material within the second interior portion.

12. The pillow of claim 11, wherein the intermediate layer includes at least one pleat to enable adjustment of volumes of the first interior portion and the second interior portion.

13. A pillow, comprising:

a first half including:

a first surface;

a second surface;

a first half interior defined between the first surface of the first half and the second surface of the first half; and a first cushioning material positioned within the first half interior;

a second half including:

a first surface;

a second surface;

a second half interior defined between the first surface of the second half and the second surface of the second half; and a second cushioning material positioned within the second half interior; and a center defined between the first half and the second half upon superimposing the first half and the second half with respect to one another, the pillow having:

a first assembled arrangement in which the pillow has a first loft and the first half and the second half are superimposed with one another, the first surface of the first half and the first surface of the second half facing one another and defining the center of the pillow; and a second assembled arrangement in which the pillow has a second loft that differs from the first loft and the first half and the second half are superimposed with one another, the second surface of the first half and the second surface of the second half facing one another and defining the center of the pillow.

14. The pillow of claim 13, wherein the first cushioning material and the second cushioning material are the same.

15. The pillow of claim 13, wherein the at least one of the first cushioning material and the second cushioning material comprises a fill material.

16. The pillow of claim 13, further comprising:

a flexible connector between a first peripheral edge of the first half and a first peripheral edge of the second half; and a coupler that selectively couples and uncouples a second peripheral edge of the first half and a second peripheral edge of the second half.

17. The pillow of claim 16, wherein:

the flexible connector is secured to the first peripheral edge of the first half at a location closer to the second surface of the first half than to the first surface of the first half;

the flexible connector is secured to the first peripheral edge of the second half at a location closer to the second surface of the second half than to the first surface of the second half;

the coupler is secured to the second peripheral edge of the first half at a location closer to the second surface of the first half than to the first surface of the first half; and the coupler is secured to the second peripheral edge of the second half at a location closer to the second surface of the second half than to the first surface of the second half.

* * * * *